US005615950A

United States Patent [19]

Frei et al.

[11] Patent Number: 5,615,950

[45] Date of Patent: Apr. 1, 1997

[54] APPARATUS FOR PREVENTING SEDIMENTATION

[76] Inventors: Alexandra S. Frei, Eidbergstrasse 64, 8405 Winterthur, Switzerland; Bernard Paringaux, 50 Blvd. Michelet, 13008 Marsielle, France

[21] Appl. No.: 557,384

[22] Filed: Nov. 13, 1995

Related U.S. Application Data

[63] Continuation of Ser. No. 292,241, Aug. 17, 1994, abandoned.

[30] Foreign Application Priority Data

Aug. 17, 1993 [CH] Switzerland ..... 02468/93

[51] Int. Cl.[6] ..... B01F 3/10; B01F 5/04

[52] U.S. Cl. ..... 366/173.1; 366/262

[58] Field of Search ..... 366/134, 136, 366/137, 262, 345, 347, 189, 137.1, 138, 153.2, 159.1, 154.1, 162.4, 163.2, 167.1, 167.2, 172.1, 173.1, 173.2, 177.1; 137/896

[56] References Cited

U.S. PATENT DOCUMENTS

| | | | |
|---|---|---|---|
| Re. 16,314 | 4/1926 | Kenney | 366/137 |
| 1,380,282 | 5/1921 | Wickersham | 366/137 |
| 1,716,294 | 6/1929 | Bond | 366/173 |
| 1,961,548 | 6/1934 | Caise | 366/173 |
| 1,992,261 | 2/1935 | Traudt | 366/137 |
| 2,432,175 | 12/1947 | Schmidt | 366/134 |
| 2,545,640 | 3/1951 | Aitken | 366/136 |
| 2,559,518 | 7/1951 | Smith | 366/134 |
| 2,582,802 | 1/1952 | Terrell, Jr. | 366/136 |
| 2,692,798 | 10/1954 | Hicks | 366/137 |
| 3,233,874 | 2/1966 | Betulius | 366/167.1 |
| 3,397,789 | 8/1968 | Valdespino | 366/167.1 |
| 3,661,364 | 5/1972 | Lage | 366/136 |
| 3,871,272 | 3/1975 | Melandri | 366/137 |
| 4,365,988 | 12/1982 | Graham et al. | 366/137 |
| 4,664,891 | 5/1987 | Cosentino et al. | 366/159.1 |
| 4,671,892 | 6/1987 | Bereiter | 366/136 |
| 4,812,045 | 3/1989 | Rivers | 366/137 |
| 5,061,080 | 10/1991 | MacKay et al. | 366/172.1 |
| 5,137,368 | 8/1992 | Kistner | 366/136 |
| 5,470,459 | 11/1995 | Barrington et al. | 366/173.1 |

FOREIGN PATENT DOCUMENTS

| | | | |
|---|---|---|---|
| 526925 | 9/1956 | Belgium | 366/136 |
| 1104630 | 11/1955 | France | 366/137 |
| 2951817 | 7/1981 | Germany | 366/136 |
| 21415 | 2/1978 | Japan | 366/136 |
| 21412 | 2/1978 | Japan | 366/136 |
| 121465 | 9/1979 | Japan | 366/136 |
| 398264 | 2/1974 | U.S.S.R. | 366/136 |
| 543995 | 3/1942 | United Kingdom | 366/137 |

OTHER PUBLICATIONS

Prakash R. Bathija, "Jet Mixing Design and Applications", *Chemical Engineering*, Dec. 13, 1982 pp. 89–94.

*Primary Examiner*—Tony G. Soohoo
*Attorney, Agent, or Firm*—Walter C. Farley

[57] ABSTRACT

A method and apparatus for preventing the deposit of sediments from multi-material mixtures, such as crude oil (4), refinery products and petrochemical products, at the bottom of a tank (T), in which the sediments form a precursor in the form of a thickening precipitation zone (4.2). The deposit of sediments is prevented by disturbing the formation of the precipitation zone (4.2). The disturbance is created in an overall disturbance patterns (S) with local disturbance regions (L) according to a disturbance pattern (S) and is brought about by disturbance apparatus (V) in a disturbance zone hydro-kinetically by the supply or removal of crude oil (4) in the disturbance zone through a pipe system (7).

8 Claims, 5 Drawing Sheets

APPARATUS FOR PREVENTING SEDIMENTATION

This is a continuation of application Ser. No. 08/292,241 filed on Aug. 19, 1994, now abandoned.

FIELD OF THE INVENTION

This invention relates to a method and an apparatus for avoiding sedimentation from liquid phases or the thickening of liquid phases or liquid mixtures such as oils, crude oil, refinery products and petrochemical products.

BACKGROUND OF THE INVENTION

During the storage of liquid phases such as oils, crude, refinery products and other petrochemical products, undesired sedimentation and thickening often occurs which will be discussed hereinafter in connection with the particular deposit-forming example of crude oil.

The liquid phase of crude oil is a mixture mainly consisting of hydrocarbons such as paraffins, aromatics and naphthenes, which are also accompanied by non-hydrocarbons or so-called impurities such as mud, water, dissolved salts, sulphur compounds, sand, etc. In certain circumstances prior to processing in refineries, the crude undergoes rough refining processes for the separation of impurities. It is then generally customary to store the crude oil to be processed and also the precleaned crude oil in large tanks. This involves holding times of varying lengths, which can be quite long in the case of stockpiling, and much shorter for operation-based storage locations.

Long holding times especially favor undesired deposit formation from crude in tanks. These deposits can be of different types, being e.g. favored by emulsions of water with hydrocarbon fractions, or can consist of segregates of heavy hydrocarbon fractions (hard waxes) or settled mud or salts. The result is a kind of oily mud which accumulates and is compressed on the bottom of tanks and leads to high costs and losses and which is referred to loosely as sludge.

Costs and losses are caused because the oil sludge reduces the capacity of the tanks and also binds crude oil or, in some cases, largely consists of thickened crude. Thus, apart from the costly space loss in the tank, storage leads to significant loss of raw material. In addition, the lost space cannot be recovered again if the sludge is stored in closed systems, i.e. tanks made available for this purpose, the undesirable alternative being a final storage which is prejudicial to the environment if the sludge is dumped into open pits or basins. In large tanks with a diameter up to 100 m, a height of 20 m and a corresponding capacity, sediment thicknesses of 1 to 2 m lead to a 5 to 10% capacity loss. In addition, the service and operation of the tanks is often made difficult because the oil sludge clogs the pumps, outflows from tanks have to be filtered, etc. Finally, down-times are linked with the removal of the oil sludge. If the oil sludge is not removed, it accumulates further and finally leads to the abandonment of sludged-up storage containers and the construction of new tanks. Apart from these storage costs the unprocessed oil sludge also represents a loss because, despite its impurities, it largely consists of utilizable hydrocarbons.

Several solutions are known for removing sediments from crude in tanks and two examples will now be given.

1) A first solution is proposed in U.S. Pat. No. 3,436,263 and French Patent 22 11 546, where cleaning substances are used for dissolving, or removing in bound form, the oil sludge. A disadvantage of this method is that, due to the cleaning substances which have been introduced, the liquified oil sludge is no longer usable because its composition has been changed by the additives and it must be disposed of in dumps or elsewhere. Such dumps are e.g. old tanks or so-called wasteland and constitute a serious pollution of the environment. Reprocessing of oil sludge is consequently not desirable using this method which, instead of combating the problem it only combats the effect. However, it is still possible to clean and reuse the tanks. The essential reason why the dissolved oil sludge cannot be processed is that the cleaning substances used represent impurities for processing in refineries, whose separation by standard cleaning methods involves great effort and is expensive and does not bear a positive relationship to the recovered crude.

2) Another solution is proposed in European Patent 160, 805, wherein hydrokinetic energy is used in order to dissolve, or suspend back into the liquid phase by means of turbulence, sedimented residues in tanks. Thus, oil sludge dissolved by crude as the dissolving substance can be returned to the process and processed in the refinery following standard cleaning procedures. This method does not prevent the formation of oil sludge but instead merely eliminates it. For this purpose, planned turbulence or eddy flows are generated, whose successive remote action is able to dissolve the deposits in an effective manner, even outside the direct injection zone. However, this requires a considerable investment. Mechanically moving components within the tanks, such as e.g. rotary liquefying lances, which hydro-kinetically activate the oil sludge and dissolve it in crude represent considerable expense. Thus, although this method leads to a high oil sludge recovery level, it is expensive. Under extreme environmental conditions, e.g. in sand or ice desert regions, this is undesired.

SUMMARY OF THE INVENTION

An object of the invention is to provide a method for largely avoiding the deposit of sediments from liquid phases or thickening in liquids or liquid mixtures such as oils, crude, refinery products and petrochemical products.

A further object is to provide such a method which is simple and safe to carry out, which is important because as a rule the storage units are monitored either little or not at all.

The basic principle of the invention is based on the observation that the precipitation from liquid mixtures, such as from crude in tanks, forms a "precursor", i.e. a preliminary event, in the form of a precipitation or thickening zone of precipitation which ultimately settles in the bottom of the tank, initiating oil sludge formation and causing increasing sedimentation. The formation of this precursor can be influenced or prevented by a relatively small disturbance or perturbation, so that deposit formation is suppressed. This precursor of sedimentation from crude comprises crude oil thickening in a precipitation zone, which so to speak "floats" or stratifies above a bottom surface of the tank. Crude constituents coagulate and polymerize in this zone of continuously increasing thickness and are deposited in the form of sediments or the like and collect on the bottom of the tank as re-utilizable oil sludge and therefore form a slowly rising bottom surface over which the precursor continues to act.

According to the invention the sedimentation from mixtures such as crude, as well as other oils, is avoided by disturbing this precursor. As opposed to a per se sensible crude recovery from the sediment, this constitutes a type of prevention technology which reduces or prevents the formation of sludge. This approach differs from the solutions given above because there is no oil sludge disposal; instead, formation of the disadvantageous oil sludge is prevented.

Most sludge formation is due to a type of gelling of the crude, which thickens and, during thickening, can be redissolved by stirring or agitating. During this phase, no dilution by additional crude is required. However, in large tanks an effective mechanical agitating or stirring system is, as a practical matter, substantially impossible so that it is necessary to find another form of planned disturbance appropriate for the enormous tanks.

According to the invention, this can be achieved by the formation of energy transporting, travelling waves in the precipitation zone, the precursor of the sludge, such as by the supply and/or removal of crude oil. Simple, maintenance-free disturbances are advantageously brought about hydrodynamically by using perforated piping, pipe systems, nozzles, etc., so that flowing crude introduces the disturbance energy into the precursor or precipitation layer. Thus, no use is made of fault-prone, movable, mechanical components, so that the method is maintenance-free, robust, mechanically simple and easy to control.

In the method according to the invention, this idea is put into effect in a highly advantageous manner, because the disturbance of the precursor and the prevention of sedimentation takes place with much smaller material and labor costs than recovery from existing sediment and it is possible to use particularly simple, proven and functionally robust equipment. A further advantage of this method is that the position and extent of the precursor, i.e., its location, can be clearly defined and consequently disturbance means can be fitted in a planned manner in that area, generally slightly above the tank bottom.

BRIEF DESCRIPTION OF THE DRAWINGS

Details of embodiments of the method and apparatus according to the invention are described in greater detail hereinafter with reference to the following drawings wherein.

DESCRIPTION OF THE PREFERRED EMBODIMENTS

Figure 1:
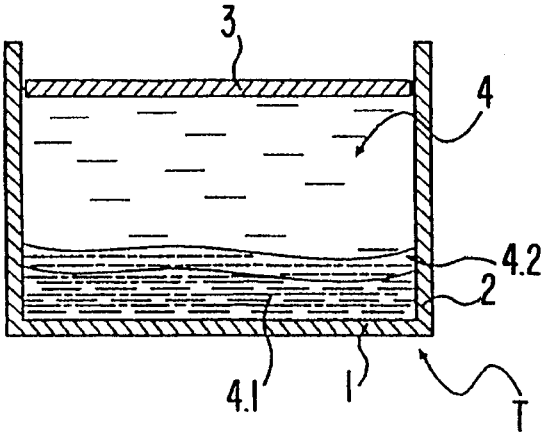
FIG. 1 is a schematic side elevation, in section, of a tank with a precipitation zone and sediment layer.

FIG. 1 is a schematic longitudinal section through a tank T having a quantity of crude oil 4 stored therein, the crude having a schematically represented precipitation zone 4.2 which is the above-discussed precursor, above a sediment layer 4.1. Tank T typically has cylindrical symmetry with an approximately planar bottom 1, a circumferential wall 2 and a floating roof 3. The capacity of such a tank T can be 100,000 $m^3$ or more. Floating roof 3 is used for safety reasons to permit the escape of volatile, flammable fractions of the stored crude 4 from the tank and therefore prevent the formation of explosive mixtures within tank T. When tank T is wholly or partly filled, the roof floats directly on the crude 4. However, the method according to the invention can obviously also be used with tanks having a fixed roof.

FIG. 1 shows the sediment or deposit layer 4.1 and a thickening or precipitation zone 4.2 above it. The sediment 4.1 can, e.g., comprise emulsions of water with hydrocarbon fractions, or segregates of heavy hydrocarbon fractions (hard waxes) or thickened crude or segregates of mud, sand, salts or rust and form a deposit ranging in viscosity from a hard deposit to a thick oily mud generally known as sludge, which has settled on the bottom 1 of the tank T. These sediments 4.1 come from a precipitation zone 4.2 which thickens toward the bottom 1 of tank T and which floats above the bottom surface of the tank T, where it has a higher density than the crude oil 4 above the sediment-forming zone which was originally introduced into the tank. Observations have shown that the vertical thickness of the sediment-forming zone 4.2 in such a tank can be up to 1 meter and is dependent on several difficult to determine parameters, such as the composition of the crude 4, the ratio of the hydrocarbon fractions, e.g., subdivided into paraffins, aromatics and naphthenes, as well as the proportion and nature of the impurities, e.g., the quantity of water or sludge.

As stated, this thickening precipitation zone 4.2 is a type of precursor for the sediment from crude 4. Thickening crude is a thixotropic mixture, which, by mechanical agitation, can change from a viscous to a less viscous, liquid aggregate state. Thickening precipitation zone 4.2 forms as soon as a specific minimum or critical quantity of crude in a tank T has found a specific, metastable equilibrium, considered over a period of time.

The critical crude quantity is typically that which permits the formation of a precipitation zone 4.2. A metastable equilibrium occurs, as a function of the nature and manner of the supply, the supply capacity and also the duration of the crude supply (with or without disturbances) in the tank and this generally occurs after only a few weeks.

The crude in tank T can be influenced by external forces.

One of these external forces, which cannot be suppressed, is gravity. Certain constituents of the crude 4 which thicken, coagulate and polymerize in a metastable precipitation zone 4.2 undergo a specific density rise with time in such a way that, under the action of gravity, they are sedimented in the precipitation zone 4.2 near the bottom surface of tank T so as to form a bottom deposit 4.1. The possibilities of the coagulation, polymerization and precipitation of crude components 4 vary widely in accordance with the large variation range in composition of such a mixture and lead the deposit constituents into a stable equilibrium in the form of sediments or deposits 4.1 or oil sludge. Similar mechanisms of precipitation apply to other substances forming liquid phases.

This interaction of gravity with the precipitation zone 4.2 apparently fluctuates. Thus, there is an expansion and spatial positioning of precipitation zone 4.2 relative to the bottom surface of the tank T, i.e. zone 4.2 takes on the form of an eventual sediment layer. The statistical composition of the upper portion of sediment layer 4.1 influences corresponding structures of the upper and lower surfaces of the precipitation zone 4.2. The growth of sediment layer 4.1 is accompanied by a more or less constant thickening of precipitation zone 4.2 (see FIG. 1).

According to the invention, the sediment from mixtures such as crude, refinery products and petrochemical products in tanks T is avoided by disturbing the metastable precipitation zone 4.2 by external forces, so as to prevent coagulation and polymerization of components of the mixtures. Based on systematic studies of the position of forming sedimentation, discovered by methodical sounding of intentionally permitted sediment formation and studying this formation and the extension or expansion of the precursor or precipitation zone 4.2 within the container, it is possible to apply to a tank T disturbing means having a planned action thereon. This method is illustrated in detail by FIGS. 2 to 4 using the example of crude oil. By "disturbing" it is meant that a portion, or possibly all, of a liquid body is agitated or stirred so that it is mixed and its characteristics change. In particular, creating a disturbance leads to such agitation that thixotropic characteristics of any liquids in the mixture cause the thickening tendencies of the mixture to reverse, particularly, in the present invention, in a selected layer of the mixture.

Four advantageous embodiments of disturbing apparatus for implementing the method of the invention are shown in FIGS. 7 to 14, where the disturbance is brought about hydro-kinetically by the supply and removal of crude as the disturbing medium of precipitation zone 4.2 of the tank. As a result, the components of the crude are moving and precipitation zone 4.2 is subject to thorough mixing due to the incompressibility of the particles.

Figure 4:
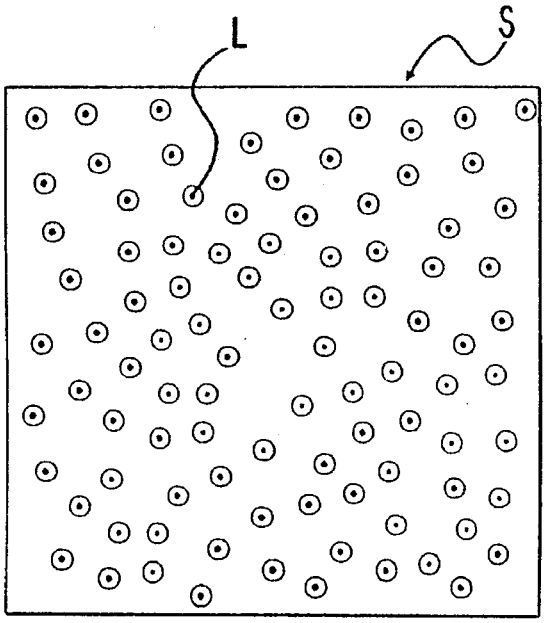
FIG. 4 is a diagram of a second embodiment of a disturbance pattern in accordance with the invention in the form of a two dimensional pattern of disturbance regions.
Figure 5:
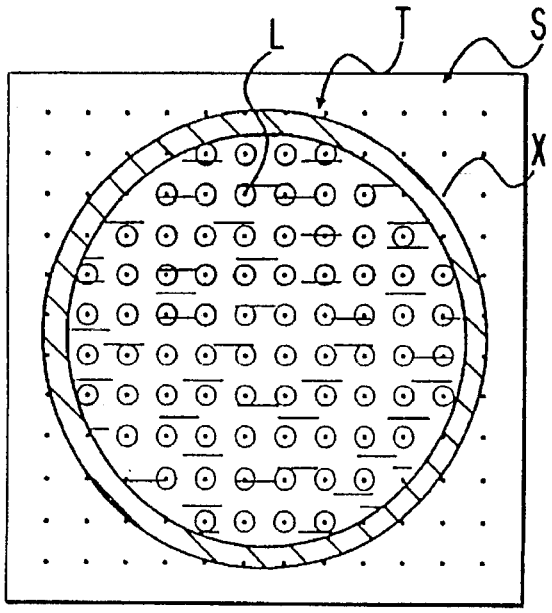
FIG. 5 is a schematic plan view of the tank of FIG. 2 superimposed on the first embodiment of a disturbance pattern according to FIG. 3.
Figure 6:
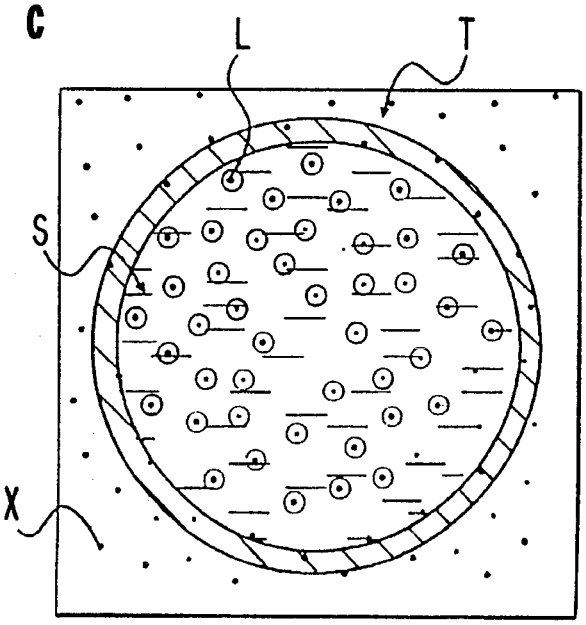
FIG. 6 is a view similar to FIG. 5 showing the tank of FIG. 2 superimposed on the second embodiment of a disturbance pattern according to FIG. 4.

FIGS. 2 to 6 illustrate the method according to the invention schematically in a plan view of part of a tank T (FIG. 2), the concept of the disturbance pattern S in two embodiments (FIGS. 3 and 4) and the superimposing of the disturbance pattern S with tank T (FIGS. 5 and 6).

Figure 2:
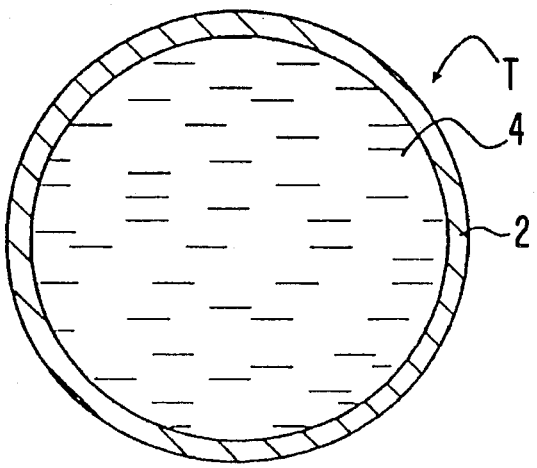
FIG. 2 is a plan view, in transverse section, of the tank of FIG. 1.
Figure 8:
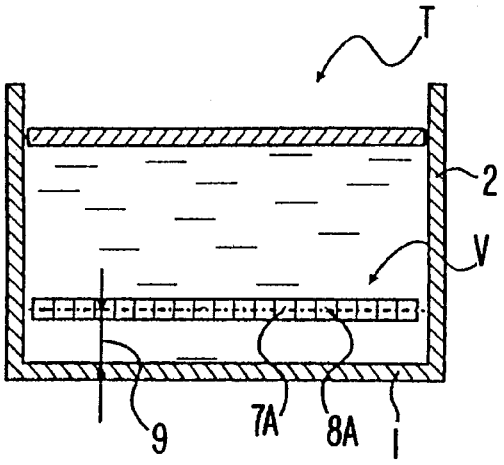
FIG. 8 is a schematic side elevation, in section along line C—C of FIG. 7, of a first embodiment of a disturbance apparatus for implementing the method according to the invention.

According to FIG. 2, tank T is, as is usually the case, cylindrical and it has a typical circular diameter of 100 m and a height of 20 m. In such an enormous container there is to be created a disturbance zone of approximately 1 m depth, which according to the concept of the global disturbance pattern S, i.e. a disturbance model, comprises a plurality of local disturbance regions L. This disturbance zone advantageously has a constant disturbance height of ½ meter with ±50 cm disturbance action, above the bottom of the tank T. The disturbance zone extends down to the bottom 1 of the tank T and has a volume of approximately 8,000 $m^3$ (bottom surface area×the vertical height of the propagation of the disturbance). The disturbance of precipitation zone 4.2 is produced by crude supply and/or removal in the present invention. The disturbance model is arranged so that it links and optimizes the shape of the tank T with the shape of the propagation of oscillations or vibrations in the mixture. With increasing knowledge of the action, specific disturbance models can be stored in a computer and can be modified and output as a function of the container, its capacity, shape and the environmental influences. According to the details of the optimized disturbance model the disturbance apparatus are then selected and implemented.

Figure 3:
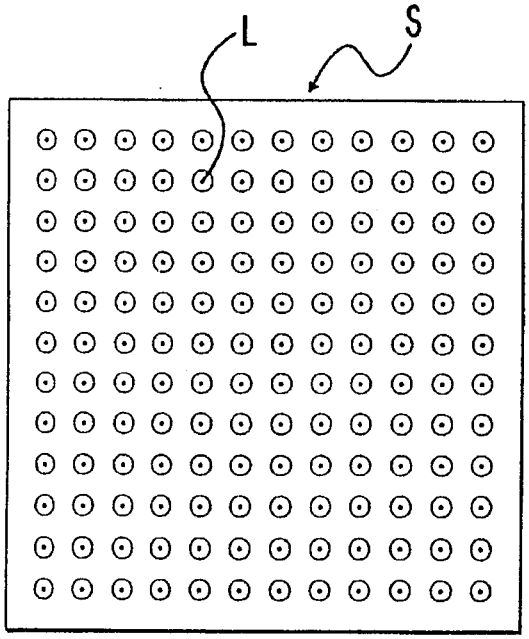
FIG. 3 is a schematic plan view of a first embodiment of a disturbance pattern in accordance with the invention in the form of a square pattern of circular disturbance regions.

In the first embodiment according to FIG. 3 the disturbance pattern S comprises a plurality of identical, symmetrical local disturbance regions L positioned in one plane. This global disturbance pattern S is represented as a two-dimensional, square pattern of disturbance circles, so that numerous local disturbances with a chessboard geometry prevent the formation of a precipitation zone 4.2.

The second embodiment of a disturbance pattern S according to FIG. 4 is a two dimensional pattern of disturbance regions L, which are in the form of more or less equidistant equally large disturbance circles. The description relative to FIGS. 7 to 14 gives details of the construction of such disturbance means.

The perturbation or disturbance regions L are given an optimum reciprocal spacing corresponding to the disturbance model, so that they are not too close together or too far apart and in the disturbance zone between them no undisturbed volume of the precipitation zone 4.2 can form. The sizes of the disturbance circles in FIGS. 3 and 4 do not represent the limits of the disturbance action of local disturbance regions L but rather merely indicate that each disturbance region L is designed in an "active" manner. It must also be borne in mind that the disturbing flows subsequently to be produced are propagated in the medium and therefore have a certain long range action, which is greater than the external design extension of disturbance regions L and is also greater than the physical extension of the subsequently produced disturbance means, such as perforated pipe systems or nozzles.

To the extent possible, disturbance must take place in a homogeneous manner and should fill the entire volume of interest. It is made local by means of the disturbance regions L and overall or global by means of the disturbance patterns S, with a view to preventing the formation of the precipitation zone 4.2 by means of such a disturbance region. It is possible to form several geometries of disturbance patterns S, e.g. three-dimensional structures, which have closely packed disturbance regions L. The disturbance regions L need not be of the same size and it is possible to combine weaker and stronger disturbance regions L, which can be provided at regular or irregular intervals. It is therefore possible in this way to overcome difficult geometry conditions in a tank T where round walls, which consequently have a "stronger" design, must be disturbed. In addition, the disturbance regions L need not be symmetrical and can instead also be randomly arranged disturbance regions with individual disturbance capacities and geometries, which have a sufficiently long range to form interfering, overlapping disturbances, which in turn have a volume-filling, homogeneous design. Even the symmetrical disturbances can vary widely. Thus, the disturbance regions can be of a wide-range nature like flat disks, which are only uniform in one disturbance plane (e.g. sinusoidal and circular) or non-uniform (e.g. elliptical) and which here again act only in the predetermined disturbance height. This is advantageous, because the precipitation zone 4.2 to be prevented is relatively flat and shallow. With the knowledge of the invention, the expert is provided with numerous possibilities for the design of local disturbance regions L and overall disturbance patterns S.

The design of the disturbance pattern S can be brought about with standardized disturbance regions L in the form of a drawing board or on the computer as a disturbance model. An advantageous tool for this purpose is electronic data processing, where complete libraries of models can be built up, field experience can be stored and converted into sets of parameters. The disturbance patterns S and disturbance regions L are then selected from a set of standardized, proven forms and, in accordance with the parameters to be fulfilled, are matched to the given geometry of the tank T or the nature of the crude 4.

FIGS. 5 and 6 show a way in which this can be done. In FIGS. 5 and 6 the disturbance patterns S according to FIGS. 3 and 4, respectively, are superimposed on the surface area of the tank T according to FIG. 2, so that the numerous disturbance regions L within the disturbance zone within the tank T can be produced by means of disturbance apparatus. The disturbance pattern S is projected onto the geometry of the tank T, there being no need to proceed in a categorical manner and instead projection can take place as a function of the type and extension of the disturbance regions L. Thus, in FIG. 5, use is made of the disturbance regions or circles L within the surface area of the tank T. However, in FIG. 6, certain disturbance regions L within the surface area of the tank T are not subsequently realized. Only the disturbance regions L found necessary by comparison with the geometry of the tank T are subsequently created in the disturbance apparatuses V. The disturbance zone consists of a volume formed by the surface area of the tank T and a disturbance depth and which advantageously encloses the precipitation zone to be disturbed. For this purpose, the disturbance regions L are produced by disturbance apparatus advantageously in the form of perforated pipe systems or nozzles. Each of these perforated pipe systems or nozzles is a local disturbance region L with a local disturbance volume. In each case, one or more pumps extract liquid from an upper portion of the tank, i.e., anywhere in the tank above the level of the sediment, and pump that liquid back into the disturbance region. The liquid can be extracted from within parts of the disturbance zone itself and the liquid can be returned into the same zone, care being taken to assure that the extraction and supply are not arranged so that a simple flow occurs between an extraction location and an adjacent supply region with any agitating currents being produced. Alternatively, the liquid can be extracted from a location in the tank higher than the disturbance zone and can then be pumped into the disturbance zone so that agitating currents are established, at least in the disturbance zone. Conventional pumps are used, the size and capacity thereof being selected to suit the tank capacity and other factors.

Figure 7:
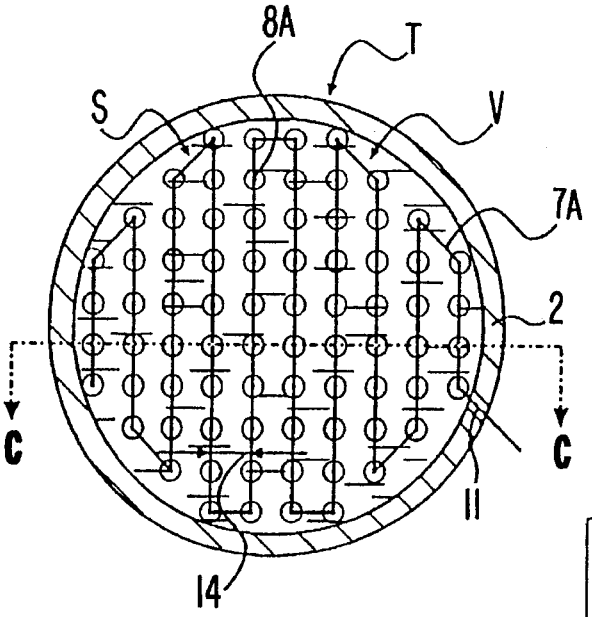
FIG. 7 is a schematic plan view of part of a first embodiment of a disturbance apparatus for implementing the method according to the invention.
Figure 9:
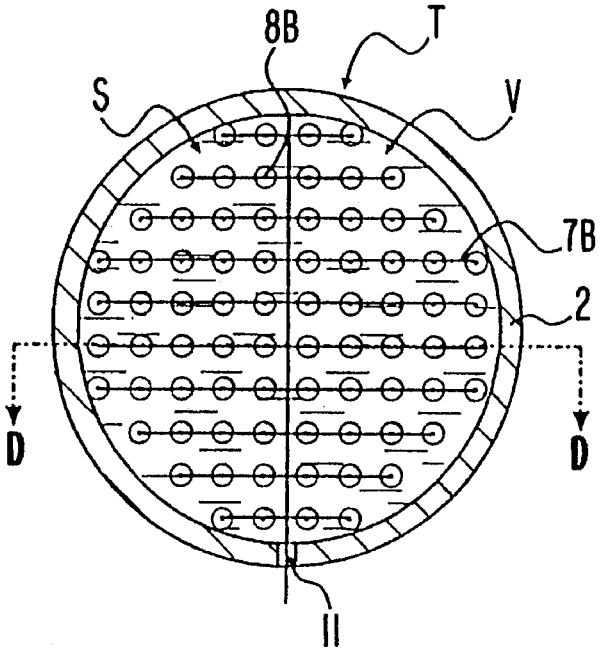
FIG. 9 is a schematic plan view of part of a second embodiment of a disturbance apparatus for implementing the method according to the invention.
Figure 10:
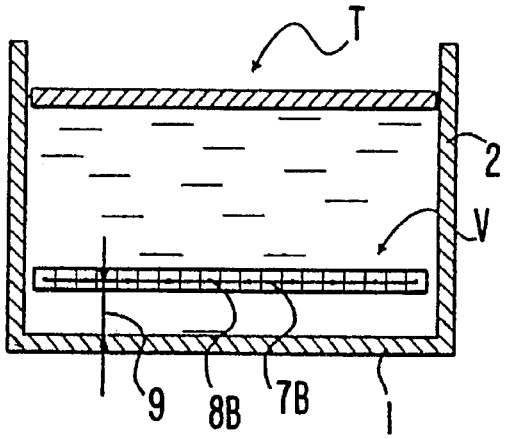
FIG. 10 is a schematic side elevation, in section along line D—D of FIG. 9, of the second embodiment of a disturbance apparatus for implementing the method according to the invention.

FIGS. 7, 8, 9 and 10 show first and second embodiments of a disturbance apparatus V for performing the method according to the invention. FIG. 7 is a plan view and FIG. 8 a side view along the sectional plane CC of a first embodiment. FIG. 9 is a plan view and FIG. 10 a side view along sectional plane DD of a second embodiment. The geometries of the disturbance apparatus V with the disturbance means 8A, 8B, 8C and 8D and the tank T are adapted to one another so as to achieve an optimum, volume-filling, homogeneous disturbance. The disturbance apparatus has, in the form of disturbance regions, disturbance means 8A–D which are nozzles through which crude 4 can flow in and out of tank T. In a cylindrical tank T having a diameter of 100 m and a height of 20 m, the disturbance means 8A–D are arranged in a chessboard geometry with a constant disturbance height 9 above the bottom 1 of the tank T, which is typically 50 cm. The disturbance zone covers the entire base area of the tank T. Using a disturbance action of ±50 cm, it extends down to the bottom 1 of tank T and encompasses the entire precipitation zone 4.2 which would otherwise be formed and which is being prevented.

In the first embodiment of the disturbance apparatus V, the disturbance regions L according to FIGS. 2 to 4 in the form of pipe systems 7A are at a constant disturbance height 9 above tank bottom 1. In precipitation zone 4.2, the pipe systems 7A supply and remove crude oil 4 with respect to the tank T, e.g. via the passages 11 of pipe system 7A. In the first embodiment according to FIG. 7 the disturbance means 8 are interconnected in linear, un-branched pipe systems 7A, whereas in the second embodiment shown in FIG. 8 the disturbance means 8B are interconnected in a branched pipe system 7B. Naturally, it is also possible to have several, independently operable pipe systems 7B. They can have independent passages 11 for the supply or removal of crude 4, but can also be operated in a dependent manner, so that the pipe systems 7B are e.g. only suppliable via a supply or drain line. Pipe systems 7 can be at the same disturbance height 9 or different disturbance heights 9 over the bottom of the tank T. They can have the same or different disturbance intervals or spacings 4 and this also applies with respect to the wall of the tank T.

Advantageously, the geometry of the disturbance apparatus V is adapted to that of the tank T, so as to ensure an optimum, i.e. volume-filling, homogeneous supply and removal of crude 4 with respect to the formation height of a precipitation zone 4.2. The depth of this disturbance zone centered on the disturbance height 9 is referred to as the disturbance depth and covers the surface area of the tank T. In the first and second embodiments of a tank T with a cylindrical geometry, a circular diameter of 100 m and a height of 20 m, there are numerous local disturbance means 8A and 8B in the form of openings, such as perforated pipe systems or nozzles and having a constant disturbance interval. They are fitted at a constant disturbance height 9 of e.g. 50 cm above the bottom of tank T. The disturbance zone covers the entire surface area of the tank T. With a typical disturbance action of ±50 cm, the perturbing action extends down to the bottom 1 of the tank T and includes the precipitation zone 4.2 to be disturbed or prevented.

The disturbance means 8A–8D of the disturbance apparatuses V are used for the supply or removal of crude 4 and are in the form of openings, such as perforated pipe components or nozzles, via which the crude 4 can flow in or out. In the present embodiment there are nozzles by means of which the crude is introduced into the disturbance zone. In the simplest case a volume-filling, homogeneous disturbance is achieved by identical disturbance sizes of these nozzles. The expert has available numerous known, proven methods to permit a uniform outflow of crude 4 from these nozzles throughout the disturbance zone. As a function of the height of the crude column in the tank, in the disturbance height 9 there is an overpressure of 10, 20 or 30 atm. Thus, in the pipe system 7A–D, the crude 4 is transported with a sufficiently high pressure to all 76 nozzles, so that also at the end of the pipe system 7A–D, there is still a full disturbance action at the final nozzle in the line. Such an adequate crude supply can be obtained in a simple, controlled manner by the use of standardized, matched nozzles (nozzle cross-section). Advantageously, the nozzles have a large opening angle, so that, e.g. directed toward the bottom I of the tank T, they supply the oil 4 in surface-covering manner thereto.

Generally the local crude quantity is determined by the pressure in the pipe systems 7A–D and the flow rate through the nozzles. For example, the crude quantity flowing out of the individual nozzles is so small compared with the quantity of crude in the pipe system 7A–D, that the outflow of crude 4 from the nozzles causes no significant pressure drop. Thus, for identical nozzles the same crude quantity can flow.

Figure 15:
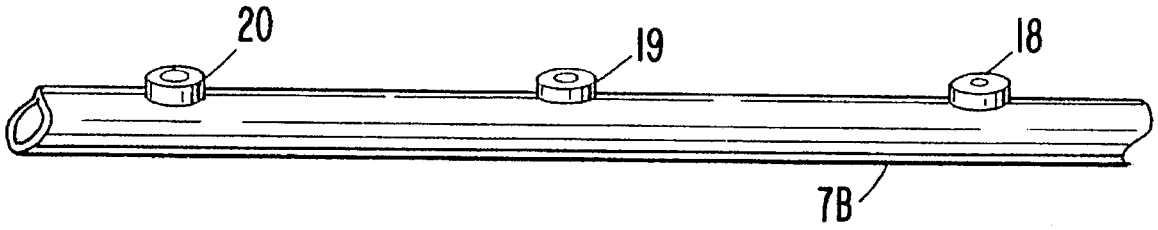
FIG. 15 is a schematic perspective view of typical nozzles having differing flow output rates.

However, should there be a pressure drop, this can be corrected by the use of nozzles having different throughputs, in such a way that the ratio of the local pressure at the nozzles in the pipe system 7A–D to the throughput of the nozzles is kept constant. At the inlet of the pipe systems close to the passages 11, where the crude 4 has its highest pressure, are fitted the nozzles with the correspondingly small oil flow rate, whereas the nozzles at the end of the pipe system 7A–D have a relatively large flow rate. As shown in FIG. 15, a portion of a pipe 7B has nozzles 18, 19 and 20 with different low rate outputs.

The hydro-kinetically acting disturbance of the formation of precipitation zone 4.2 can also be accomplished by a combined removal and supply of crude oil 4 from the disturbance zone by means of several pipe systems 7A–D as disturbance apparatus V. In this case, crude 4 would be fed in by means of pipe systems 7A–D (e.g. via nozzles) and would simultaneously be removed by means of other pipe systems (e.g. sucked out by openings in said systems 7).

Pipe system 7A and 7B of the first and second embodiments can be constructed using standardized pipe components used in the crude oil processing industry, such as e.g. rigid steel components, linear extension pieces, elbows made with a selected bend angle and T-pieces, which can be welded together and are permanently fixable to the bottom of the tank T. Such pipe components typically have circular diameters of 5 to 20 cm and, at the positions of the disturbance regions L to be produced, they have openings or connecting means for the installation of nozzles. Such connecting means can be welding sockets or standard flanges. These pipe systems 7A, 7B can, e.g., be supported by forked stands at the disturbance height 9 and fixed to the bottom 1 of tank T.

Figure 11:
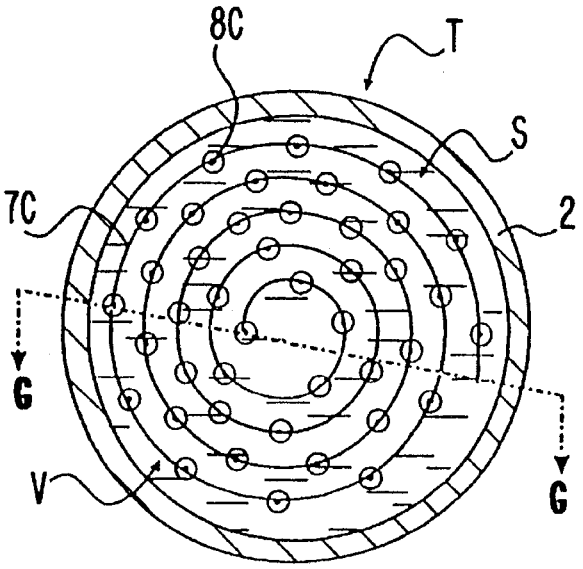
FIG. 11 is a schematic plan view of part of a third embodiment of a disturbance apparatus for implementing the method according to the invention.
Figure 12:
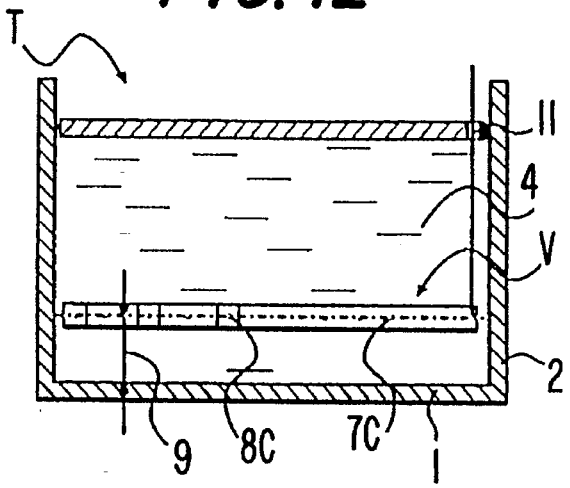
FIG. 12 is a schematic side elevation, in section along line G—G of FIG. 11, of a third embodiment of a disturbance apparatus for implementing the method according to the invention.

FIGS. 11 and 12 schematically show a third embodiment of a disturbance apparatus V for the method according to the invention. FIG. 11 shows a plan view and FIG. 12 a side view in section along line GG of FIG. 11. This disturbance apparatus V also comprises at least one pipe system 7C fixed in the interior of the tank T which permits the supply and removal of crude 4 via disturbance means 8C in the form of openings, such as perforated pipe systems or nozzles in the tank T, so as to prevent the formation of a precipitation zone 4.2.

The description of this third embodiment of a disturbance apparatus V substantially coincides with that of the first and second embodiments according to FIGS. 7 to 10. However, in this case the pipe system 7C is formed from flexible pipe components or reinforced, pressure-resistant hoses, which can be made from metal such as steel or steel alloys. Such hoses have typical circular diameters of 10 to 20 cm and can be laid from a reel in larger lengths, much as with the laying of cables, in accordance with a predetermined disturbance pattern S.

These reinforced, pressure-resistant hoses have the advantage of flexible laying. Such a flexibly layable pipe system 7C comprising one or more connected hoses laid in a tank T with a diameter of 100 m with a fixed disturbance height 9 of 50 or 60 cm in accordance with a disturbance pattern S in the form of a spiral for the production of individual disturbance regions and the connection thereof requires no special manufacture of pipe components such as extension pieces and bends. Thus, as a result of the laying the pipe components need no longer be interconnected by means of flanges, which saves time and material. It is merely necessary to fit the openings or nozzles. This can take place during or after the laying operation by drilling openings, cutting threads and fitting standardized connecting means such as flanges, so that the nozzles can be connected to the pipe system 7C.

A further advantage of the flexibly layable pipe system 7C is the simplification of the design of the disturbance pattern S and the bringing about of a particularly effective disturbance zone. As a result of the spatial flexibility of the flexibly layable pipe system 7C, the shape of the disturbance pattern S and the shape of the pipe system 7C can be matched to one another. Unlike in the first and second embodiments, in the third embodiment there is an interaction between the design of the disturbance pattern S and the laying of the pipe system 7C.

Thus, with the knowledge of the length of the hose provisionally laid in a spiral manner in pipe system 7C, it is virtually possible in situ to calculate the necessary number of nozzles required for an effective disturbance in a spiral disturbance pattern S. In this stage of the method rough details are obtained, a hose is laid but not fixed and a specific disturbance pattern S is calculated for the tank T. This calculation advantageously makes use of table or computer-based expert systems, e.g. by means of electronic data processing.

On the basis of these details, both the flexibly layable pipe system 7C and the disturbance pattern S are matched to one another, the local positions of the hose can be easily modified and the local position, nature and size of the nozzles can be varied. Thus, the hose may e.g. no longer have perfect spirals and instead it may locally have small structures in the form of waves or the like. These adaptations can take place on the basis of random, external circumstances, because otherwise there would not be optimum local disturbances in accordance with the disturbance pattern S. The obstacles which are to be taken into account in this fine matching, can be turbulence and flows on the walls of the tank T. It is important to create the maximum freedom in the design of the disturbance pattern S. The disturbance pattern S does not require a predetermined chessboard configuration as in the first and second embodiments of FIGS. 7 to 10 and instead the details are optimized. The latter are naturally freely selectable, so it is not essential to lay the pipe system 7C in the form of a spiral, although this is practical and advantageous.

Following this optimization stage, the flexibly layable hose is permanently fixed e.g. on the bottom 1 of the tank T, openings are made in the hose at the calculated, optimized positions of the nozzles and the latter can be fitted by means of said openings and further connecting means such as cut threads or standardized flanges, so that the nozzles 8C are connected in pressure-tight manner to the pipe system 7C. The same observations as made concerning the first and second embodiments apply to the selection of the nozzles. The pressure in the pipe system 7C and the throughput or flow rate of nozzles 8C to be fitted must be so matched to one another that the crude oil 4 can be transported at a sufficiently high pressure to all the nozzles and consequently also has a full disturbance action on the final nozzle at the end of pipe system 7C.

Figure 13:
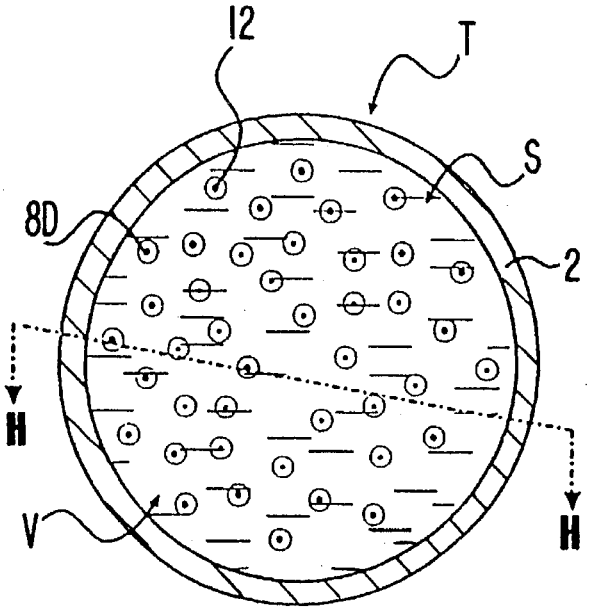
FIG. 13 is a schematic plan view of part of a fourth embodiment of a disturbance apparatus for implementing the method according to the invention.
Figure 14:
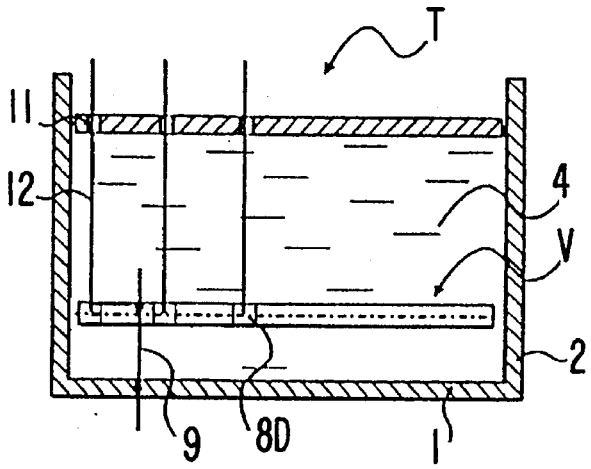
FIG. 14 is a schematic side elevation of a fourth embodiment of the disturbance apparatus, in section along line H—H of FIG. 13, for implementing the method according to the invention.

FIGS. 13 and 14 schematically show a fourth embodiment of a disturbance apparatus V for the method according to the invention.

Even though the fitting of stationary disturbance regions in the precursor volume with disturbance apparatus carried by the storage container bottom appears to be simple from the structural standpoint, it is also possible to supply the disturbance from above, i.e. from the top of the container. For this purpose it is appropriate to have a "floating roof" whose top already has a large number of supports. Into those supports can be inserted or installed lances, through which the disturbance flow can be introduced into the precursor. FIG. 13 shows a plan view and FIG. 14 a side view in section along line HH of FIG. 13. This disturbance apparatus V comprises a plurality of lances 12 attached to floating roof 3 of tank T and which permit the supply and removal of crude 4 via disturbance means 8D in the form of openings such as nozzles on the lances 12 in the tank T and consequently prevent the formation of a precipitation zone 4.2—the supply network not being shown.

Unlike the first three embodiments according to FIGS. 7 to 12, in this case lances 12 are fitted to passages 11 in the floating roof 3 of the tank T and extend down to a disturbance height 9, to there supply and/or suck off crude 4 by means of disturbance means 8D such as nozzles and in this way form the disturbance regions. The lances 12 can be made from standard pipe components used in the crude oil processing industry, such as rigid steel components, linear extension pieces, etc.

The disturbance regions L in tank T, e.g. in accordance with any of the disturbance patterns discussed above, are now realized as lances 12 and disturbance means 8D, which are not fixed to the bottom 1 of the tank T, but instead to its floating roof 3. These lances 12 can be connected for the supply and removal of crude 4 by means of a common pipe system located outside the tank T, but can also be individually connected to other crude oil reservoirs for the supply and removal of crude 4. The disturbance zone covers the entire surface area of the tank T. With a typical disturbance action of ±50 cm they extend down to the bottom 1 of the tank T and enclose the precipitation zone 4.2 to be disturbed or prevented. As soon as the floating roof drops (on removal) or rises (on refilling), the lances are again "set to disturbance height". In this way it is possible without any reconstruction, new construction, etc. with respect to a storage container, to immediately arrive at the indicated preventative advantages, although this is somewhat more complicated. Following the emptying of the storage container, it is then possible to pass to a preventatively acting apparatus in accordance with the above embodiments and reuse the released lances in other containers.

What is claimed is:

1. A sediment-preventing apparatus comprising a container including a bottom having a total area defined by at least one wall;

a body of liquid in said container and having a top surface, said liquid having a tendency to stratify and thicken in a stratification zone above said bottom of said container and thereafter precipitate into sediment at the bottom of the container;

a conduit array immersed in said liquid and lying substantially in a plane in said zone above said bottom of said container and below said top surface of said body of liquid, said conduit array having an inlet opening and a multitude of outlet nozzles each being capable of ejecting liquid in a predetermined direction, said multitude of outlet nozzles being distributed throughout said plane over an area substantially equal to said total area of said bottom and being arranged to eject liquid in a plurality of different directions toward and away from said at least one wall and above and below said plane when said inlet opening is supplied with liquid under pressure;

a supply lance extending substantially vertically from above said top surface of said liquid to said inlet opening; and pump means for extracting liquid from said container and supplying said liquid under pressure to said supply lance and thereby to said inlet opening, whereby liquid is ejected from said nozzles in different directions to disturb said stratification zone, thereby to prevent sedimentation in said container.

2. An apparatus according to claim 1 and further comprising a roof for said container floating on said top surface of said body of liquid, said supply lance being connected to and supported by said roof.

3. An apparatus according to claim 1 and further comprising a roof for said container fixedly attached to a top of said container, said supply lance being connected to and supported by said roof.

4. An apparatus according to claim 1 wherein said conduit array comprises a plurality of substantially rigid pipes;

means for supporting said pipes in a generally horizontal array in said stratification zone, each of said pipes having a plurality of said nozzles spaced along said pipes, said nozzles thereby forming a pattern of disturbance locations distributed throughout said plane.

5. An apparatus according to claim 4 wherein a portion of said pipes are substantially parallel with each other.

6. An apparatus according to claim 4 wherein said multitude of outlet nozzles comprise a plurality of nozzles with different flow rates, said nozzles being arranged in each of said pipes so that nozzles closer to said supply lance have smaller flow rates than nozzles more distant from said supply lance, thereby tending to equalize flow from said nozzles.

7. An apparatus according to claim 1 wherein said conduit array comprises a flexible, spiral conduit;

means for supporting said conduit in a generally horizontal plane in said stratification zone;

a plurality of said nozzles spaced along said conduit, said nozzles thereby forming a pattern of disturbance locations distributed throughout said plane.

8. An apparatus according to claim 7 wherein said nozzles comprise a plurality of nozzles having different throughputs, said nozzles being arranged along said conduit so that each nozzle has a smaller throughput than nozzles more distant from said supply lance, thereby tending to equalize flow from said nozzles.

* * * * *